US006289588B1

(12) United States Patent
Graf

(10) Patent No.: US 6,289,588 B1
(45) Date of Patent: Sep. 18, 2001

(54) PROCESS FOR MANUFACTURING A DEVICE FOR TREATING TEXTILE FIBERS

(75) Inventor: Ralph Armin Graf, Freienbach (CH)

(73) Assignee: Graf & Cie AG, Rapperswil (CH)

( * ) Notice: Subject to any disclaimer, the term of this patent is extended or adjusted under 35 U.S.C. 154(b) by 0 days.

(21) Appl. No.: 09/232,784

(22) Filed: Jan. 19, 1999

(30) Foreign Application Priority Data

Apr. 30, 1998 (EP) ..... 98107985

(51) Int. Cl.[7] ..... B21K 1/02
(52) U.S. Cl. ..... 29/895.31
(58) Field of Search ..... 29/895, 895.31, 29/895.3; 427/299, 318, 319, 327; 148/240, 336, 405, 409, 414

(56) References Cited

U.S. PATENT DOCUMENTS 5,547,709 8/1996 Lukschandel et al. .

FOREIGN PATENT DOCUMENTS

| | | | |
|---|---|---|---|
| 2 149 591 | 3/1973 | (FR) | D01G/15/00 |
| 2 048 323 | 12/1980 | (GB) | D01G/9/06 |
| WO 91/15605 | 10/1991 | (WO) | C21D/8/06 |
| WO 94/05837 | 3/1994 | (WO) | D01H/4/32 |

*Primary Examiner*—Paul T. Sewell
*Assistant Examiner*—Marc Butler
(74) *Attorney, Agent, or Firm*—Darby & Darby

(57) ABSTRACT

The process serves to manufacture textile-processing devices such as card cylinders of ring-shaped configuration that comprise an all-steel wire clothing, or circular combs that are fitted with outward-facing saw-toothed wire sections. The wires (3) or the wire sections (13) are pre-bent to conform to the curvature of the ring (1) or circular comb mounting support (12), then surface-hardened through the application of a diamond/Ni layer, and finally anchored on the ring or circular comb mounting support.

17 Claims, 2 Drawing Sheets

PROCESS FOR MANUFACTURING A DEVICE FOR TREATING TEXTILE FIBERS

BACKGROUND OF THE INVENTION

1. Field of the Invention

The present invention concerns a process for manufacturing a device for treating textile-fibers, preferably of wool, cotton, or fibers of natural as well as synthetic polymers. One example for a device of this kind is a card cylinder of ring-shaped configuration with an all-steel wire clothing, particularly an open-end clothing, as used in carding machines that particularly serve to improve the staple of raw fiber material, and another example are circular combs comprising wire sections on the outside, as used in combing machines that particularly serve to parallelize the individual fibers of fiber fleeces, where the saw-teeth of the all-steel clothing or, respectively, of at least the first of the wire sections of the circular combs are subjected to a hardening process.

2. Description of the Related Art

In the manufacture of ring-shaped card cylinders of the aforementioned kind, in order to avoid expensive single-piece configurations of a steel ring with a steel-tooth wire, it is customary to hold the steel-tooth wire in place by inserting its foot portion in a helicoidal groove that runs around the surface of the ring. In this, it has proven more advantageous to make the ring of aluminum rather than of steel, because with the use of aluminum, a secure anchoring of the wire is achieved by applying pressure in the vicinity of the groove. A problem arises, however, with the hardening of the teeth of the installed wires, e.g., through electrochemical plating, subsequent to the manufacture of the ring steel-wire unit.

SUMMARY OF THE INVENTION

The object of the present invention is to provide a process by which card cylinders or circular combs of combing machines with comparatively longer useful life spans can be manufactured in a relatively simple manner while eliminating the aforementioned disadvantages.

With the aforementioned process, the essence of the solution is that the wires or the wire sections, while they are still separate units before being anchored on the ring or on the circular comb mounting support, after the customary blanking operation for cutting the teeth followed by through-hardening for increased tooth strength and electrochemical deburring, are pre-bent to conform to the curvature of the ring or circular comb mounting support, respectively, before they are subjected to a surface hardening process and finally anchored on the ring or circular comb mounting support. Card cylinders that are made in this manner have outstanding wear resistance of the sawtooth points even over comparatively long periods of use. The same applies to circular combs in which the leading first wire sections that suffer the greatest amount of stress can be subjected to a hardening process as separate components after they have undergone the pre-forming operation.

Following the operations of blanking, electrochemical deburring of the sawteeth, and pre-bending of the saw-toothed wire or wire sections to match the curved surface of the ring or the circular comb mounting support, it has proven to be particularly advantageous from a manufacturing point of view if, in accordance with the invention, the subsequent surface hardening process comprises a coating through the application of a diamond/Ni layer. In this, it is particularly beneficial if the wires are first subjected to a helicoidal pre-bending operation, then a surface hardening process of their saw-toothed portion, after which whey are installed on the ring.

In the inventive process, the best advantage from the helicoidal pre-bending of the saw-toothed wire is obtained if the latter, in its stress-free condition, has an internal diameter corresponding approximately to the- outside diameter of the cylindrical ring so that the saw-toothed wire coil will slide onto the cylindrical ring or otherwise can be installed by rolling it into the groove. The all-steel wire coil which thereby occurs as an intermediate product, so to speak, requires comparatively little space and is thus relatively convenient to handle for the subsequent installation on the ring that forms the body of the card cylinder.

If the saw-toothed wires used in the clothing are of the kind that has a foot and, issuing from the foot, a blade with a sequence of sawteeth, and if the cylindrical ring is provided on the outside with a helicoidal groove of a substantially rectangular cross-section that is delimited by two lateral walls and matched to the corresponding cross-section of the foot of the saw-toothed wire that is to be introduced into the groove, then it is very beneficial according to a further development of the invention, if at least one of the walls that laterally delimit the ring groove is deformed by a radial compressive force in such a manner that, after the foot has been introduced into the groove, ring material from the compressed domain of the wall is forced into a fluted recess that is provided in the flank of the foot and extends over the entire length of the saw-toothed wire. In this relatively simple manner, a secure mechanical coupling of the saw-toothed wire to the ring is accomplished.

As a further advantageous feature, for the first step of inserting the saw-toothed wire helix conveniently and securely into the groove of the ring, the process is distinguished in that on the side of the foot of the sawtoothed wire, a shoulder is formed to allow the application of a radial force for pressing the pre-shaped saw-toothed wire into the groove.

The invention is practiced with similar advantage in the case of a circular comb mounting support with several successive wire sections. Following its manufacture in a shape that matches the curvature of the circular comb mounting support, the leading wire section in the direction of combing, whose teeth are spaced farther apart than the teeth of the next as well as of the following sections, is mounted on the circular comb mounting support preferably by cementing, e.g., by means of a one- or two-component adhesive. This improvement of the first, leading section, is very beneficial in that it increases the useful life of the circular comb significantly, because all sections wear out at about the same time, at which point the entire comb will be exchanged.

BRIEF DESCRIPTION OF THE DRAWING

Further details, advantages and distinguishing features will be presented in the following description, making reference to the attached drawing, wherein.

Figure 1:
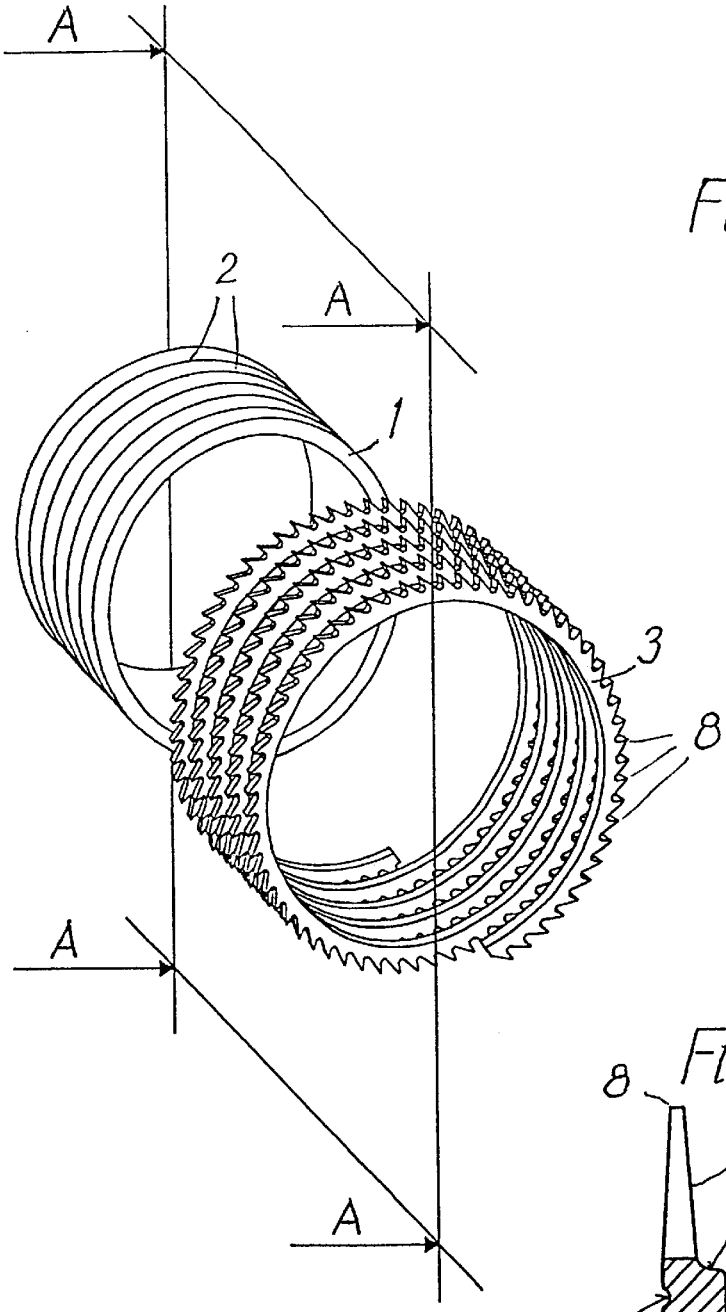
FIG. 1 shows a perspective view of the constituent parts of a card cylinder before the two parts that form the card cylinder are joined together.
Figure 3:
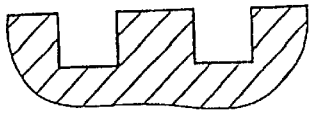
FIG. 3 shows a detail portion III of FIG. 2, enlarged at a ratio of 10:1.
Figure 2:
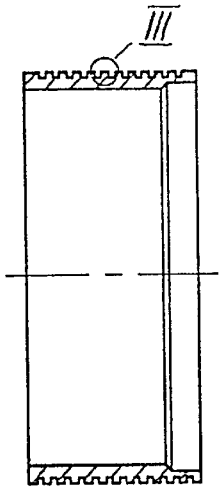
FIG. 2 shows an axial section through one of the parts along the plane indicated as A—A in FIG. 1, i.e., through the cylindrical ring that forms the body of the card cylinder.

As may be seen in the drawing, the body of a card cylinder, made of aluminum in the shape of a cylindrical ring 1, is provided with an helicoidal groove 2 as indicated only in a schematic fashion in FIG. 1, the groove serving to secure an all-steel wire 3 that has been pre-formed into the shape of a helix. The sectional views of FIGS. 2 and 3 show that the helicoidal groove 2, which has been cut into the outer surface of the cylindrical ring 1, is delimited by lateral walls 4 and 4' which run parallel to each other and extend to the transverse bottom 5 of the groove 2, so that the groove 2 has a practically rectangular cross-section.

Figure 4:
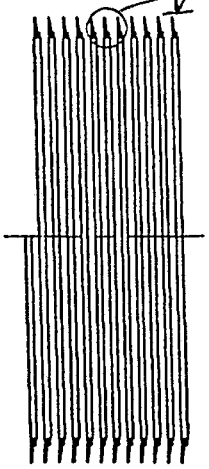
FIG. 4 shows an axial section through the all-steel wire that is pre-bent in the shape of a helix and represents the other of the two parts of the card cylinder.
Figure 5:
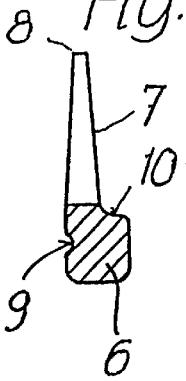
FIG. 5 shows a detail portion V of FIG. 4, enlarged at a ratio of 10:1.

As shown in FIGS. 4 and 5, the all-steel wire 3, which forms the clothing and is designed in the shape of a saw-toothed wire, comprises a foot 6 and issuing from the latter a blade 7 with a sequence of saw-teeth 8. In FIG. 5 one recognizes a flute 9, located on one side of the rectangular cross-section of the foot 6 and extending in the lengthwise direction of the wire.

The cross-section of the foot 6 is designed to conform to the cross-section of the groove 2. Thus, the foot 6 can be press-fitted into the groove. For this purpose, the shape of the foot 6 of the all-steel wire 3 incorporates a lateral shoulder 10.

In accordance with the invention, after the teeth have been cut in a blanking operation and then through- hardened to increase their strength to resist deformation under stress, the saw-toothed wire is pre-bent to conform to the shape of ring 1, i.e., it is given the helix shape that is shown in FIG. 1. Subsequent to an electro-chemical demurring operation, the saw-teeth are subjected to a surface hardening process by applying a diamond/Ni layer, which may be preceded by the application of a base layer of Nickel.

The aforementioned diamond/Ni layer of a thickness of approximately 0.5 to 2 mμassures the desired superior hardness of the surface of the saw-teeth while, on the other hand, the all-steel wire 3 in its foot portion 6 remains sufficiently flexible to allow the slight additional bending that occurs during the installation on the ring 1—or on a solid cylinder that carries ring 1. Due to the pre-formed helix shape, the surface layer, which could not be applied to the continuous band material, cannot break during the installation in the groove because there is only a small amount of additional bending.

Figure 7:
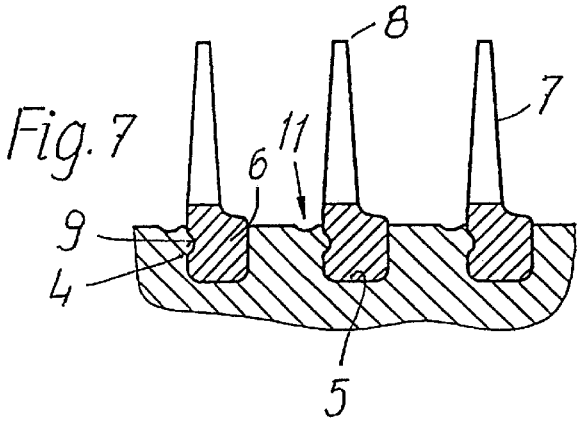
FIG. 7 shows a detail portion VII of FIG. 6, enlarged at a ratio of 10:1.
Figure 6:
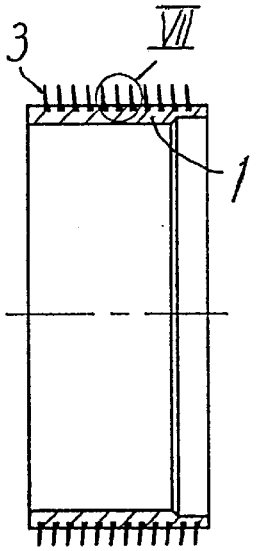
FIG. 6 shows an axial section through the card cylinder in its assembled condition.
Figure 8:
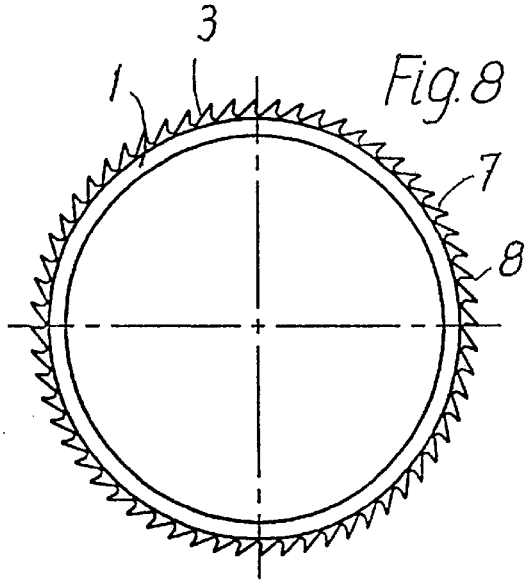
FIG. 8 shows a frontal view of the card cylinder of FIG. 6.

After the pre-bent, helix-shaped saw-toothed wire 3 has been slipped onto the ring 1, the aforementioned process of pressfitting and anchoring the wire into the helix-shaped groove 2 is accomplished in the manner indicated in FIGS. 6 and 7. Namely, when the wire 3 is inserted into the groove 2, it is brought into contact with the bottom 5 of the groove and, practically at the same time, a narrow roller presses radially against the top of the wall 4—as indicated by an arrow 11—so that ring material is forced from the compressed domain of the wall 4 into the flute 9 of the saw-toothed wire 3, thereby providing a sufficiently strong mechanical connection between the ring 1 and the wire 3.

Figure 9:
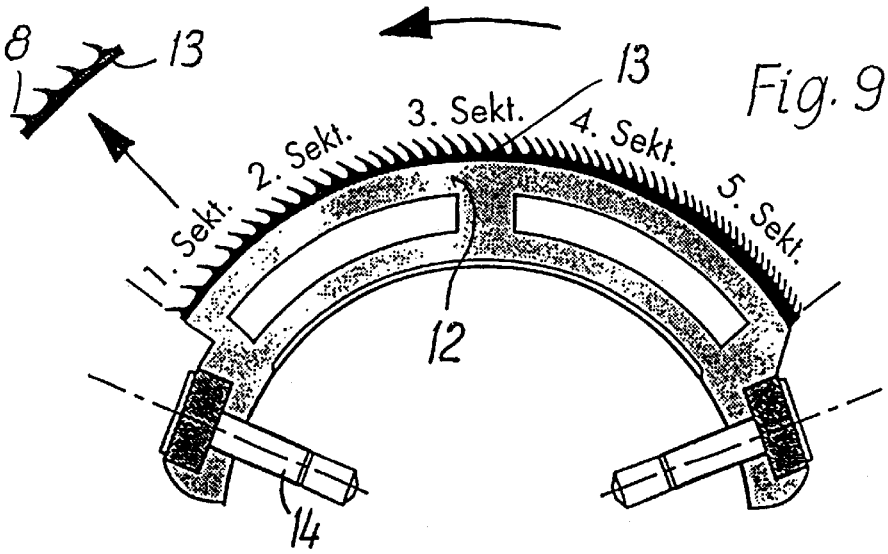
FIG. 9 shows a cross-sectional view of a circular comb with a plurality of wire sections installed in sequence on a circular comb mounting support.

FIG. 9 shows a circular comb mounting support 12 on which several successive wire sections 13 are installed. By means of screw bolts 14, the circular comb mounting support 12 is releasably connected to the non-illustrated substructure.

The teeth 8 of the individual wire sections are spaced at a pitch that differs from one section to the next. The section that is last in the combing direction has the shortest pitch.

Therefore, the teeth of the leading section 13 in the direction of combing are spaced at the largest distance compared to the next and all of the following sections.

At their inside surface, i.e., on the side facing the circular comb mounting support 12, the different wire sections 13 have a curvature that conforms to the curvature of the outside surface of the circular comb mounting support 12. Thus, they may conveniently be attached with sufficient strength to the outside surface of the circular comb mounting support 12 by means of a one- or two-component adhesive, unless a mechanical connection is preferred.

The teeth of the first and leading wire section 13 relative to the combing direction are subject to the greatest amount of wear because of their particularly intense contact with the fiber material that is to be combed, such as a fiber fleece. As a result of the inventive pretreatment of particularly the first wire section, practically all sections will wear out at about the same time. At that point, the entire comb is exchanged.

In analogous manner, if comparatively stronger compact cylinders are used instead of the cylindrical rings 1, it is also possible to remove a worn-out saw-toothed wire and to fit the cylinders with a new wire.

What is claimed is:

1. A process for manufacturing a device for treating textile fibers including a support body having a support surface with a predetermined curvature and at least one saw-tooth wire strip which is anchored on said support surface, said process comprising the steps of:

producing the saw-tooth wire strip by subjecting a starting material to a blanking operation for forming a plurality of saw-teeth;

through-hardening the saw-teeth of said saw-tooth wire strip;

deburring the saw-teeth of the saw-tooth wire strip;

pre-bending the saw-tooth wire strip to produce an intermediate product conforming to the predetermined curvature;

subjecting the intermediate product to a surface hardening process; and anchoring the surface hardened intermediate product on the support surface.

2. The process in accordance with claim 1, wherein the surface hardening process comprises applying a diamond and nickel layer coating.

3. The process in accordance with claim 1, wherein said pre-bending operation comprises forming the saw-tooth wire strip into a helix shape.

4. The process in accordance with claim 3, wherein the surface hardening process is performed on the saw teeth.

5. The process in accordance with claim 4, wherein the support body is a cylindrical ring with a groove defined in its outer surface.

6. The process in accordance with claim 5, wherein the helix-shaped sawtoothed wire, in a stress-free state, has an inner diameter approximately equal to an outer diameter of the cylindrical ring so that the saw-toothed wire helix is one of: (i) positionable over the cylindrical ring, and (ii) rollable into and securely installable in the groove.

7. The process in accordance with claim 6, wherein the saw-toothed wire comprises:

a foot; and a blade projecting from the foot, the plurality of saw-teeth being formed in the blade.

8. The process in accordance with claim 7, wherein the groove has a substantially rectangular cross-section delimited by two lateral walls, the cross-section of the foot substantially corresponds to a cross-section of the groove so as to seat the foot in the groove.

9. The process in accordance with claim 7, wherein the foot has a flank and a fluted recess defined in the flank and extending over an entire length of the saw-toothed wire.

10. The process in accordance with claim 9, wherein the anchoring step comprises:

inserting the foot into the groove; and deforming at least one of the lateral walls so that the wall is forced into the fluted recess.

11. The process in accordance with claim 7, wherein the foot forms a shoulder disposed on a side of the foot.

12. The process in accordance with claim 11, wherein the anchoring step comprises applying a radial force to the shoulder to press the saw-toothed wire into the groove.

13. The process in accordance with claim 1, wherein the support body is a circular comb mounting support and the saw-tooth wire strip includes a sequence of wire sections.

14. The process in accordance with claim 13, wherein the surface hardening process comprises applying a diamond and nickel layer coating.

15. The process in accordance with claim 13, wherein the anchoring step comprises bonding at least a first wire section of the sequence of wire sections to the circular comb mounting support using an adhesive.

16. The process in accordance with claim 15, wherein the adhesive is a single component adhesive.

17. The process in accordance with claim 15, wherein the adhesive is a two-component adhesive.

* * * * *